US005743812A

United States Patent [19]

Card

[11] Patent Number: 5,743,812

[45] Date of Patent: Apr. 28, 1998

[54] GOLF DRIVER AND METHOD OF MAKING SAME

[75] Inventor: Richard C. Card, Dallas, Tex.

[73] Assignee: MasterGrip, Inc., Irving, Tex.

[21] Appl. No.: 662,068

[22] Filed: Jun. 12, 1996

[51] Int. Cl.[6] ..... A63B 53/04; B05D 1/00

[52] U.S. Cl. ..... 473/327; 473/328; 473/331; 473/345; 473/350; 427/372.2

[58] Field of Search ..... 473/324, 349, 473/342, 327, 328, 330, 331, 345, 346, 350; 273/167 S

[56] References Cited

U.S. PATENT DOCUMENTS

| | | | |
|---|---|---|---|
| 3,218,072 | 11/1965 | Burr | 473/342 |
| 3,966,210 | 6/1976 | Rozmus | 273/169 |
| 3,989,861 | 11/1976 | Rasmussen | 427/180 |
| 4,519,612 | 5/1985 | Tsao | 273/163 |
| 4,741,535 | 5/1988 | Leonhardt | 273/164 |
| 4,754,971 | 7/1988 | Kobayashi | 273/77 A |
| 4,872,684 | 10/1989 | Dippel | 273/164 |
| 4,951,953 | 8/1990 | Kim | 273/80 B |
| 4,960,279 | 10/1990 | Harris, Jr. | 273/164 |
| 5,029,865 | 7/1991 | Kim | 273/175 |
| 5,221,087 | 6/1993 | Fenton et al. | 473/342 |
| 5,362,047 | 11/1994 | Shaw et al. | 273/77 A |
| 5,362,056 | 11/1994 | Minotti | 273/175 |
| 5,423,535 | 6/1995 | Shaw et al. | 273/77 A |

*Primary Examiner*—George J. Marlo
*Attorney, Agent, or Firm*—Hill, Steadman & Simpson

[57] ABSTRACT

A golf driver club and a method for making a golf driver club comprising the steps of:

applying a curable coating composition comprising polytetrafluoroethylene to exterior surfaces of a driver head to provide a wet coated driver head;

drying the wet coated club driver head by heating at elevated temperatures of from about 350° F. to about 400° F. for from about 4 to about 10 minutes to provide a dried driver head;

curing the dried driver head by heating at an elevated temperature of from about 790° F. to about 820° F. for a period of from about 4 to 8 minutes, and thereafter, heating at a temperature of from about 700° F. to about 800° F. for a period of from about 10 to about 30 minutes to provide a driver club head having a cured, firmly adherent coating disposed thereon. The coating has a thickness of from about 20 um to about 40 um, and is effective to reduce backspin of a golf ball hit with said driver club by at least about 10% fewer RPM as compared to a similar driver club not having said coating. The combined properties of the driver are capable of increasing driving distances by about 5 to about 25 yards. The coating is effective to provide the club face with a kinetic coefficient of friction which is less than about 50% of the kinetic coefficient of friction of the club face of a similar driver club not having said coating.

22 Claims, 2 Drawing Sheets

GOLF DRIVER AND METHOD OF MAKING SAME

BACKGROUND OF THE INVENTION

The present invention generally relates to woods or drivers for a set of golf clubs. More particularly, it relates to a new and improved golf driver club having modified surface characteristics for providing increased club speed, reduced backspin and increased driving distances.

A conventional set of golf clubs includes woods and irons identified by different club numbers. The club length, head loft and head weight characteristics are such that the club length decreases gradually and the head loft and head weight increases gradually in accordance with a gradual increase of the club number.

In a conventional set of golf clubs, the woods are used for distance shots. The lower numbered woods 1 and 2, frequently referred to as drivers, generally provide the longest hitting distances. The driver clubs include a shaft with a handle or grip at one end and a club head on the other end. The club head generally includes a body portion with a club face defined thereon.

Modern drivers are commercially available with driver club heads made from various materials, such as wood, metal, ceramic or polymers. Newer drivers are made from metal materials, such as steel, stainless steel, aluminum alloy, graphite, titanium, and the like. In these more modern metal woods, the club face is formed directly with the remaining portions of the club head body during the casting and forming operations. In addition, the underside or sole surface of the club head may optionally be provided with a separate sole plate, which is secured to the club body for use. The club face or hitting surface on these club head bodies may be smooth or grooved.

Generally, the trajectory of flight of a ball and the distance of subsequent roll is affected by the amount of backspin, the initial launch angle, and the initial ball velocity of the ball hit by the club head.

Every golfer would like to increase the distance achieved with a driver, both in terms of carry distance and distance of subsequent roll. To achieve this objective, a driver having the ability to impart a desired minimum amount of spin to a golf ball is desired.

Better players today prefer to use a high spin golf ball for all but their very long shots, where they would prefer to use a low spin ball if they could. High spin golf balls provide better ball control making it easier to place the ball close to the hole on shorter shots. For this reason, nearly all professional golfers use a high spin golf ball. The professionals are willing to sacrifice at least ten yards of their driving distance in exchange for better ball control on short strokes. Average golfers, on the other hand cannot afford the loss in driving distances provided with the high spin golf balls. Professionals and amateurs alike would benefit from a low spin driver which could be used with a high spin golf ball and provide better driving distances.

SUMMARY OF THE INVENTION

In accordance with the present invention, a new and improved golf driver club is provided. The golf driver club comprises a driver club head having club face, which has a cured, firmly adherent coating disposed on the club face or the entire driver club head. The coating provides a reduced coefficient of friction which provides a unique combination of improved hitting and driving characteristics. In an embodiment, the coating provides a kinetic coefficient of friction which is less than that of an uncoated driver club preferably by at least about 50% and especially preferably by greater than about 60%. The new and improved golf driver clubs provide a reduced amount of backspin to a golf ball hit with the driver club by at least about 10% fewer RPMs as compared to a similar driver club which does not include the coating thereon. The reduced backspin generally provides the golfer with two significant benefits. Firstly, when the moving club head strikes the golf ball, some of the energy is used to spin the ball rather than to propel the ball in a forward direction. In a normal drive, the spin imparted is always a backspin and not a forward spin. The use of a low spin driver causes the ball to spin less so that more energy is used to increase the distance of both carry and roll for a given launch angle.

Secondly, when a backspin golf ball strikes the ground, for any given descent angle and velocity, the spin rate will determine the golf ball's resistance to rolling farther forward. The friction of each bounce on the ground reduces the backspin until the ball's backspin will become a forward spin as it finally rolls to a resting position. The roll portion of the golf ball's total distance will depend on the amount of backspin on the golf ball such that higher backspins result in shorter rolls.

The coated driver clubs of this invention are capable of imparting reduced spin so that side spin is also reduced, thereby limiting the incidence of slicing and hooking. The new and improved golf driver clubs are also characterized by a slightly increased club speed, on the order of an increase of at least about ⅓ of a mile per hour, to provide further improvements in distance and driving performance.

In accordance with the invention, a driver club head comprises a cured, firmly adherent coating disposed on the club head comprising a polytetrafluoroethylene coating composition. The cured coating preferably has a dry film thickness of from about 20 μm to about 40 μm. In accordance with the preferred embodiment, the coating is a multilayer coating, including a primer layer, a midcoat layer, and a topcoat layer.

The new and improved reduced spin drivers and the coating disposed thereon may generally comprise any driver club head material capable of withstanding exposure to the curing temperatures for the coating composition. The club faces may be smooth or grooved. The beneficial performance and improvements provided by the new and improved reduced backspin coatings are generally realized regardless of driver club type as compared with an uncoated similar driver club.

Other objects and advantages of this invention will become apparent from the following Detailed Description, taken in conjunction with the Drawings, in which:

DETAILED DESCRIPTION OF THE PREFERRED EMBODIMENTS

Figures 1, 2:
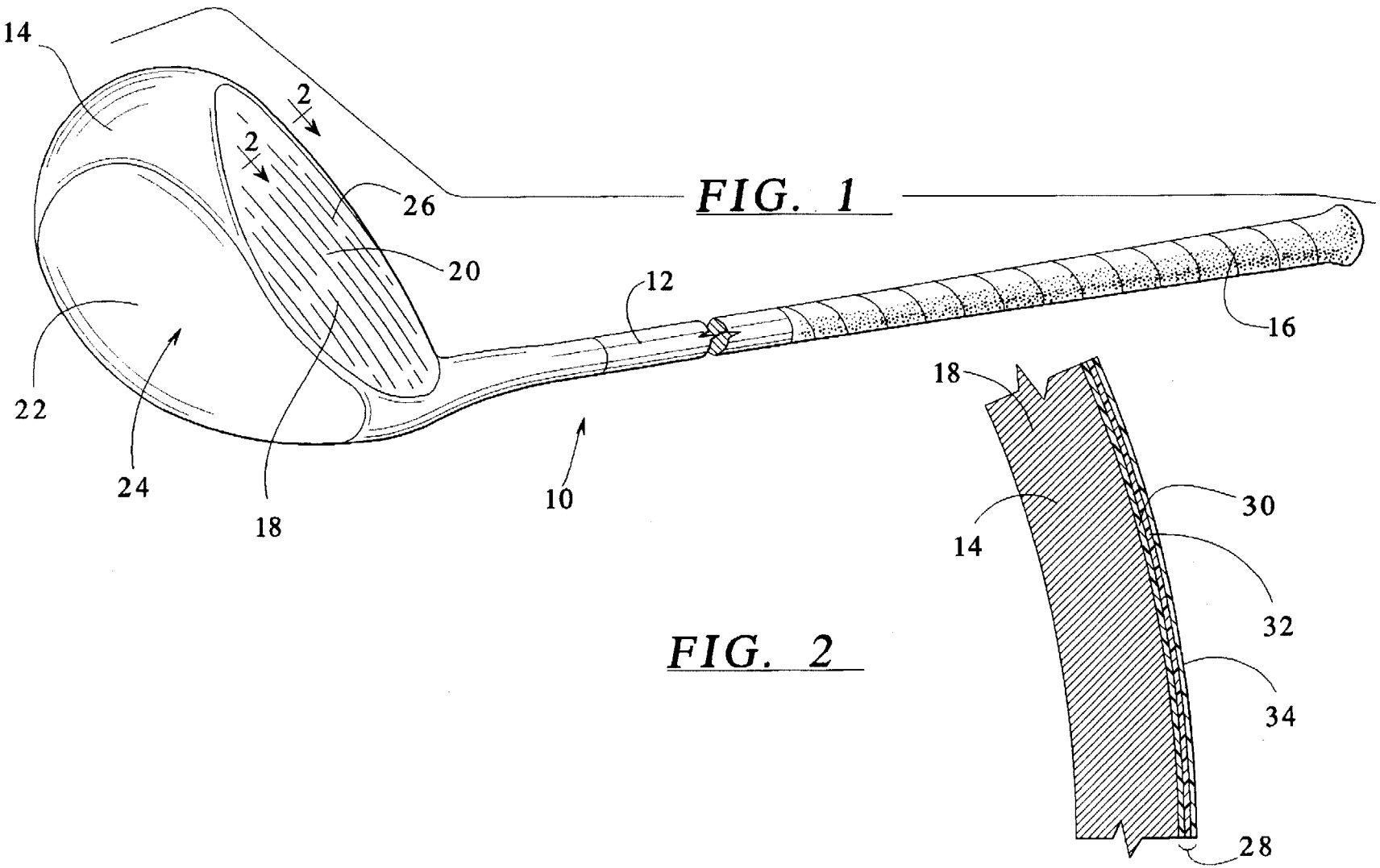
FIG. 1 is a perspective view of the new and improved reduced spin driver club in accordance with the present invention.
FIG. 2 is a fragmentary cross-sectional view of the new and improved reduced spin driver club head in accordance with the present invention, taken along view lines 2—2 of FIG. 1.

Referring now to FIG. 1, a new and improved golf driver club in accordance with the present invention, generally referred to by reference numeral 10, is shown. Golf driver 10 includes an elongated, resilient, cylindrical shaft 12. A club head body 14 is connected to a first end of shaft 12 and a handle grip section 16 is provided adjacent the opposed end.

In the preferred embodiment shown in FIG. 1, club head body 14 includes a club face 18 defining a hitting surface 20, as well as a sole plate 22 provided on the sole or underside surface 24 of head body 14. Sole plate 22 may be fixedly secured to head body 14 by any suitable securement means, such as, for example, mechanical fasteners, adhesives and welding. Hitting surface 20 may be substantially smooth or grooved as at 26 as shown. Head body 14 preferably comprises a hard, impact resistant material exhibiting good dimensional stability at elevated temperatures of up to about 1000° C. or more. The head body 14 may comprise metal, ceramic and composite materials. Illustrative materials include: steel, stainless steel, aluminum alloy, graphite and titanium.

The particulars of driver club construction, including shaft construction and design, handle construction and design, head construction and design, and methods for connecting the shaft and club head are generally known to those skilled in this art and may be employed in the manufacture and construction of the new and improved drivers of the present invention.

Referring now to FIG. 2, the new and improved golf driver club 10 in accordance with the invention further comprises a cured, firmly adherent coating 28 disposed on hitting surface 20, which is effective to reduce backspin, increase club speed, and reduce the incidence of hooking or slicing. In accordance with the invention, the coating 28 is capable of modifying the surface characteristics of the hitting surface such that a golf ball hit with the coated driver 10 has at least about 10% fewer RPM as compared to a similar driver which does not have a coating 28. Preferably coating 28 is effective to reduce the coefficient of friction of hitting surface 20 so that a reduced backspin driver is provided. Coating 28 preferably provides a kinetic coefficient of friction for the coated club head which is less than 50% of that provided by an uncoated club head. In a preferred embodiment, the new and improved coating is effective to reduce the kinetic coefficient of friction of a club head about one-third of the value for uncoated club heads, i.e., greater than a 65% reduction in kinetic coefficient of friction. Generally, coating 28 is derived from a coating composition comprising polytetrafluoroethylene or other fluorocarbon polymer. The cured coating should be hard, durable, impact resistant and firmly adhere to the club head body 14, the face 18 and sole plate 22, if present. The coating 28 should be permanent and not be a temporary application.

Coating compositions comprising polytetrafluoroethylene are known and commercially available under the tradename TEFLON® from E. I. DuPont de Nemours & Co. In accordance with the preferred embodiment of FIG. 2, an especially preferred coating system is a TEFLON® Industrial SilverStone SUPRA® coating system available, from DuPont Fluoroproducts, Wilmington, Del.

As shown in FIG. 2, coating 28 is a multilayer coating including a primer coat layer 30, a midcoat layer 32, and a topcoat layer 34. More particularly, primer coat layer 30 comprises a SilverStone SUPRA® Primer Blue layer, product code 459-80, available from DuPont. The primer coat includes polytetrafluoroethylene, polyamide-imide polymer and polytetrafluoroethylene/perfluoronated vinyl-ether as polymeric components provided in an aqueous solution including sodium aluminum sulfo-silicate (Ultramarine Blue) as pigment and methyl pyrrolidone, furfuryl alcohol and diethanolamine as curing agents and co-solvents. The primer coating composition has a viscosity of from about 100 to about 300 centipoise and comprises 23.4% by weight solids, 13.2% by volume solids.

The midcoat layer 32 preferably comprises a SilverStone SUPRA® Pewter midcoat layer, product code 456-186, available from DuPont. The midcoat layer includes polymers of polytetrafluoroethylene, perfluoroethylene/perfluoroalkylvinylether polymer and an acrylic polymer. The polymers are present in an aqueous solution including octylphenoxypolyethoxyethanol as surfactant, together with diethylene glycol monobutyl ether, oleic acid, triethanolamine and an aromatic hydrocarbon. The midcoat composition contains about 43% by weight solids, 25.5% by volume solids and has a viscosity of from about 200 to about 500 centipoise.

Topcoat layer 34 comprises a SilverStone SUPRA® Topcoat Sparkling Clear, product code 456-480, available from DuPont. The coating composition for forming topcoat layer 35 comprises polytetrafluoroethylene and an acrylic polymer in an aqueous solution which additionally contains octylphenoxypolyethoxyethanol surfactant, diethylene glycol monobutyl ether, oleic acid, triethanolamine and an aromatic hydrocarbon. The topcoat composition contains about 43.9% by weight solids, 26% by volume solids and has a viscosity of from about 200 to 500 centipoise.

Figure 3A:
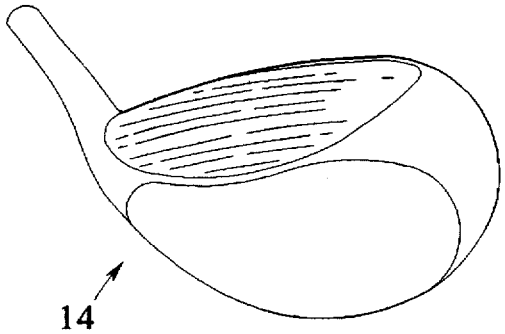
FIGS. 3A–3D are perspective views of the method of making the new and improved reduced spin drive club in accordance with the present invention.
Figure 3B:
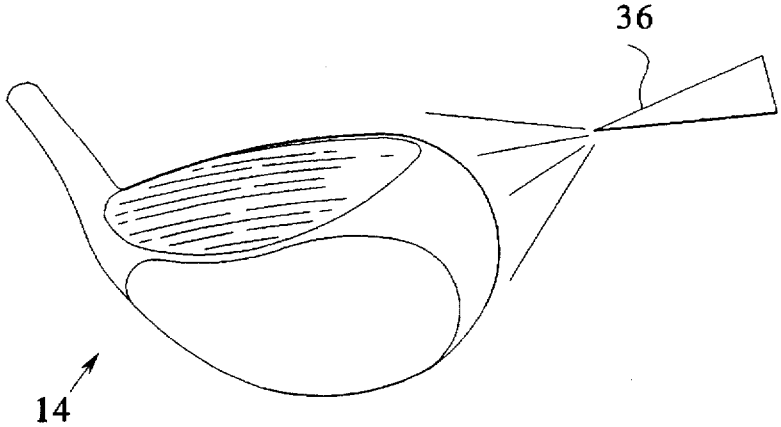
Figure 3C:
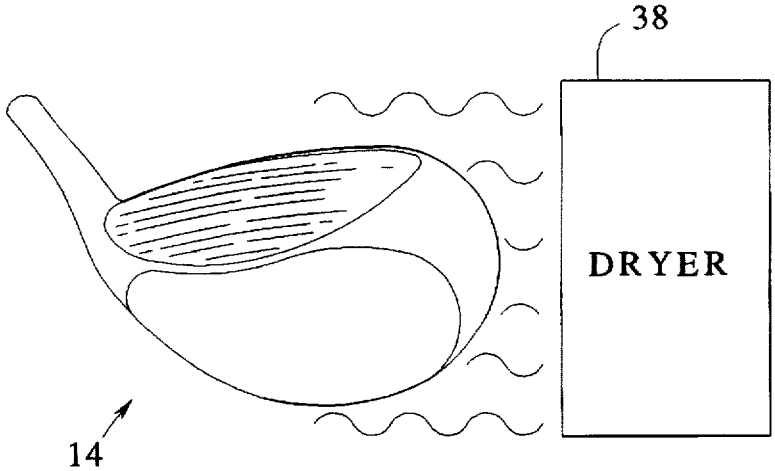

The SUPRA® system is a three-coat system, but there is no bake between coats. The film build ratio and baking are critical in achieving optimum performance. Each of the coating layers is applied using a standard compressed air spraying equipment, such as a sprayer 36 shown in FIG. 3B, using air pressure of from about 30 to 50 psi (2.1–3.5 kg/cm$^2$) and a fluid pressure of 5 to 8 psi (0.3–0.6 kg/cm$^2$) or high volume-low pressure (HVLP) equipment at 5 to 7 psi (0.35 to 0.5 kg/cm$^2$). Air-less and air-assisted equipment are not recommended because of the high shear provided in these types of equipment. The primer, midcoat and topcoat may be applied over a clean driver head body or hitting surface at a blast profile of 150 microinches. If the driver head body or hitting surface comprise stainless steel, a blast profile of 100 microinches may be used. The primer coat is applied at 0.3 to 0.4 mils (8 to 10 microns) of dry film thickness. If primer is applied to a stainless steel surface, it may be applied at 0.2 to 0.3 mils thickness. The primer layer should be allowed to dry thoroughly before the midcoat layer is applied. Infrared lamps, shown schematically in FIG. 3C as a dryer 38, and good air movement may be used to accelerate drying of the primer layer.

The midcoat is applied as a wet spray using low air pressure at about 30 to about 50 psi (2.0 to 3.5 kg/cm$^2$) to minimize rapid evaporation of water and solvents. The temperature of the piece should be kept at or below 100° F. when applying the midcoat. The midcoat layer can be applied so that it provides 0.4 to about 0.5 mils (10 to 13 microns) of dry film thickness.

Figure 3D:
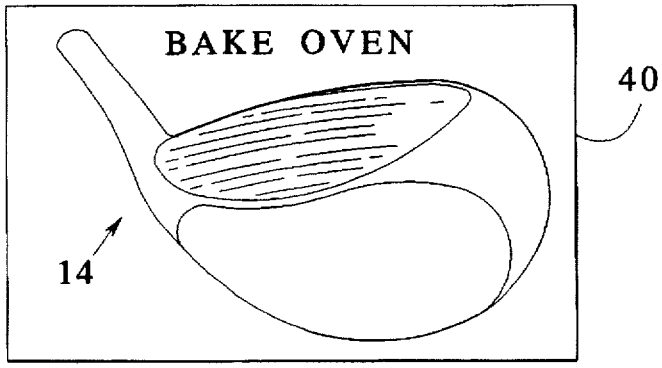

After the midcoat layer is applied, the topcoat layer may be applied also using the wet spray technique on to the wet intermediate layer at a thickness of 0.3 to 0.4 mils (8 to 10 microns) in dry film thickness. After the three-layer coating has been applied to the driver head body, the driver head body is subjected to a baking cycle, such as in a bake oven 40 as shown in FIG. 3D, to cure the applied coating compositions to form a hard, firmly adherent coating capable of changing the surface coefficient of friction for the club in accordance with the present invention.

More particularly, the coated club head is forced dry at a temperature below about 400° F. (200° C.) for at least about four minutes. Alternatively, the baking cycle may be adjusted so that it takes at least four minutes to heat up the part to about 400° F. (200° C.). Too rapid heating may cause blistering of the coating composition. After a 400° F. preheat for four minutes, the coated club driver head is baked at 790° to 820° F. (420° to 440° C.) for about five minutes at metal temperature. Care should be taken not to exceed 820° F. (440° C.). After the high temperature baking cycle, the temperature may be maintained at a temperature of about 700° F. (370° C.) for ten minutes or less.

If the bake cycle is too high or too long, the coating may become dull or hazy and mar easily. Haze can be minimized by quenching in cold water as soon as the piece is removed from the oven. A temporary haze on the coated part may be removed by wiping with a soft cloth.

New and improved coated driver club head 14 has a firmly adherent TEFLON® coating 28 having a cured coating thickness of from about 20 to about 40 μm. The coating is effective to provide reduced spin to a golf ball hit with a driver club by at least about 10% fewer RPM as compared with a similar driver club not having a coating. The coated club driver head will also preferably be characterized by providing an increase in club head speed of at least about ⅓ of a mile per hour as compared to a similar driver club not having a coating applied thereon as measured on a mechanical golfing machine. Although polytetrafluoroetylene coatings are preferred as the coatings for use herein, other coatings capable of increasing the club head velocity or decreasing the RPMs of a golf ball hit with a coated club head as described herein may also be used.

The new and improved golf drivers provided in accordance with the present invention provide increased club head speed and reduced backspin to provide, for a given trajectory, a maximum distance in terms of carry and maximum subsequent roll of golf balls hit with the new and improved driver clubs. Generally, a consistent golfer may be expected to improve driving distances by from about 5 to about 25 yards or more per drive with the new and improved coated driver clubs of the present invention. The reduction of backspin provided by the new driver clubs also reduces the incidence of side spin so that the frequency of hooked or sliced shots is effectively reduced with the new and improved driver clubs of the present invention.

Other objects and advantages of the present invention will become apparent from the following Examples:

EXAMPLES 1–3

In each of the following examples, commercial club heads available from a variety of manufacturers including both smooth and grooved hitting faces were tested with and without an applied polytetrafluoroethylene coating in accordance with the teachings of this invention. Hitting performance of each of the clubs was evaluated using the mechanical golfer available from True Temper Sports, Inc.

The True Temper Sports mechanical golfer is a mechanical device which hits the golf ball reproducibly like a human. It is capable of providing impact velocities repeatable within plus or minus ½ of a percent. The mechanical golfer may hit drives up to 250 yards in the air in about an eight-yard circle and can hit from a tee or off the turf. The mechanical golfer allows you to constantly monitor the velocity of the swing. Photographic attachments permit ball speed and spin to be measured for each hit. High speed film attachments allow measurement of the dynamic behavior of the shaft and head. The device permits measurement of the performance with off-center hits reproducibly. The mechanical golfer has become the industry standard for reproducibility and objectivity with respect to measuring the performance of golf club equipment.

In each of the following examples, a standard club head type selected from the GUARDSMAN OSZ® standard club, both with and without grooves on hitting face, were used or the T-REX® standard driver with grooves was used as the club head body. Some of the club heads were coated with the SilverStone SUPRA® coating system in accordance with manufacturer's instructions and in accordance with the coating and baking cycles identified hereinabove. The finished club had a hard, firmly adherent TEFLON® coating thereon having a coating thickness of from about 20 to 40 μm. The coated and uncoated club heads were attached to similar shafts and each driver club had a weight which was the same to the nearest tenth of a gram. Each of the clubs were tested for driving performance using the mechanical golfer with the Flashcam Spin Analysis attachment using an Orbit® golf ball. In accordance with these studies, the relative club speed was measured and the RPMs or backspin of a golf ball hit with a golf club was measured. The results of these standardized tests are set forth in Table 1 as follows:

TABLE 1

DRIVING PERFORMANCE OF COATED vs. UNCOATED DRIVERS

| EXAMPLE | A | 1 | 2 | B | 3 |
|---|---|---|---|---|---|
| CLUB TYPE - | | | | | |
| GUARDSMAN ® OSZ, with grooves | X | X | — | — | — |
| GUARDSMAN ® OSZ, no grooves | — | — | X | — | — |
| T-REX ® with grooves | — | — | — | X | X |
| SUPRA ® coating | No | Yes | Yes | No | Yes |
| DRIVER PERFORMANCE | | | | | |
| Average Backspin, RPM* | 4607.24 | 3883.01 (−723.23) | 2404.81 | 3809.60 | 3394.91 (−414.69) |
| Average Club Speed, mph* | 88.84 | 89.27 | 89.53 | 89.67 | 89.95 |

*Average of at least 6 trials

The results of Table 1 demonstrate the unexpectedly improved backspin reduction and increased club head speed for coated club heads in accordance with the present invention as shown in Examples 1 and 3 in comparison with the same club without the coating as shown in Examples A and B, respectively. Especially good backspin reduction and increased club head speeds were provided with a coated driver having a smooth, non-grooved club face of Example 2.

EXAMPLE 4

In the following example, the coefficients of friction for a standard club head hitting surface and a coated club head hitting surface prepared in accordance with the present invention were compared in accordance with ASTM D-1894-93 standard test methods. In these studies, triplicate test panels were prepared including panels finished with a standard driver coating and panels finished with a cured Silverstone Supra® coating on top of the standard driver coating. The Supra® coated panels were prepared in accordance with the methods of Examples 1–3. A Titleist DT90® golf ball was secured in a sled to prevent rotation and pulled across the panels at a rate of 6 inches per minute and the static and kinetic coefficients of friction were measured. The results are set forth in Table 2, as follows:

TABLE 2

Friction Coefficients of Coated vs. Uncoated Driver Surfaces

| EXAMPLE | C | 4 |
|---|---|---|
| Standard Uncoated Driver Surface | X | — |
| Supra ® Coated Driver Surface | — | X |
| Coefficient of Friction | | |
| Static | | |
| 1 | 0.10 | 0.07 |
| 2 | 0.05 | 0.07 |
| 3 | 0.31 | 0.04 |
| Average | 0.15 | 0.06 |
| Kinetic | | |
| 1 | 0.16 | 0.05 |
| 2 | 0.21 | 0.05 |
| 3 | 0.14 | 0.05 |
| Average | 0.17 | 0.05 |

The result of Table 2 indicates that the kinetic coefficient of friction for the coated driver surface of Example 4 was 0.05, as compared to 0.17 for the standard uncoated driver surface of Example C, representing about a 70% reduction in kinetic coefficient of friction for the new and improved low friction, low spin drivers of the present invention.

Although the present invention has been described with reference to certain preferred embodiments, modifications or changes may be made therein by those skilled in the art without departing from the scope and spirit of the present invention as defined by the appended claims.

What is claimed is:

1. A golf driver club comprising:

a driver club head including a club face having a cured, firmly adherent coating disposed on the club face, said coating comprising polytetrafluoroethylene, said coating being effective to provide reduced backspin to a golf ball hit with said driver club by at least about 10% fewer RPM as compared with a similar driver club not having said coating.

2. A golf driver club as defined in claim 1, wherein said club face is a substantially smooth planar surface.

3. A golf driver club as defined in claim 1, wherein said club face includes a plurality of grooves defined therein.

4. A golf driver club as defined in claim 1, wherein said cured coating has a thickness of from about 20 to about 40 μm.

5. A golf driver club as defined in claim 1, wherein said coating is a multilayer coating.

6. A golf driver club as defined in claim 1, wherein said coating is a multilayer coating including a primer layer, a midcoat layer and a topcoat layer.

7. A golf driver club as defined in claim 1, wherein said coating is formed from a coating composition comprising: a polytetrafluoroethylene polymer, a perfluoroalkylene perfluoroalkylvinylether polymer and a acrylic polymer.

8. A golf driver club as defined in claim 1, wherein said coating is disposed on the club face and remaining portions of said driver club head.

9. A golf driver club as defined in claim 1, wherein said driver club head comprises metal.

10. A golf driver club as defined in claim 1, wherein said driver club head comprises steel, graphite, or titanium.

11. A golf driver club as defined in claim 1, wherein said coated driver club provides an increase in club head speed of at least about ⅓ mile per hour compared to a similar driver club not having said coating as measured on a mechanical golfer machine.

12. A golf driver club as defined in claim 1, wherein said driver club head includes a sole plate.

13. A golf driver club as defined in claim 1, further comprising a shaft member connected to said driver club head.

14. A golf driver club as defined in claim 1, wherein said coating is effective to provide the club face with a kinetic coefficient of friction which is less than about 50% of the kinetic coefficient of fiction of the club face of a similar driver club not having said coating.

15. A method for making a golf driver club comprising the steps of:

providing a club driver head including a club face defined thereon;

applying a curable coating composition comprising polytetrafluoroethylene to exterior surfaces of said club driver head to provide a wet coated driver head;

drying the wet coated club driver head by heating at elevated temperatures of from about 350° F. to about 400° F. for from about 4 to about 10 minutes to provide a dried driver head;

curing the dried driver head by heating at an elevated temperature of from about 790° F. to about 820° F. for a period of from about 4 to 8 minutes, and thereafter, heating at a temperature of from about 700° F. to about 800° F. for a period of from about 10 to about 30 minutes to provide a driver club head having a cured, firmly adherent coating disposed thereon, said coating having a thickness of from about 20 μm to about 40 μm, and said coating being effective to reduce backspin of a golf ball hit with said driver club by at least about 10% fewer RPM as compared to a similar driver club not having said coating.

16. A method as defined in claim 15, wherein in said applying step the coating composition is applied by compressed air spraying methods at an air pressure of about 30 psi to about 50 psi and a fluid pressure of about 5 psi to about 8 psi.

17. A method as defined in claim 15, wherein in said applying step the coating composition is applied with high volume low pressure method at about 5 psi to about 7 psi.

18. A method as defined in claim 15, wherein said curable coating composition has a solids content of from about 20% to about 45% by weight and a viscosity of from about 100 CP to about 500 CP.

19. A method as defined in claim 15, wherein said curable coating composition comprises polytetrafluoroethylene, perfluoroethylene perfluoroalkylvinylether polymer and an acrylic polymer in an aqueous organic solvent.

20. A method as defined in claim 15, wherein said curable coating composition further comprises at least one surfactant.

21. A method as defined in claim 15, wherein said club driver head comprises steel, graphite or titanium.

22. A golf driver club comprising:

a driver club head including a club face having a cured, firmly adherent coating disposed on the club face, the coating comprising polytetrafluoroethylene, said coating being effective to provide the club face with a kinetic coefficient of friction which is less than about 50% of the kinetic coefficient of fiction of the club face of a similar driver club not having said coating.

* * * * *